US010315248B2

(12) United States Patent
Smith et al.

(10) Patent No.: US 10,315,248 B2
(45) Date of Patent: Jun. 11, 2019

(54) METHODS AND APPARATUSES USING CAST IN CORE REFERENCE FEATURES

(71) Applicant: GENERAL ELECTRIC COMPANY, Schenectady, NY (US)

(72) Inventors: Douglas Ray Smith, Hamilton, OH (US); Gregory Terrence Garay, West Chester, OH (US); Zachary Daniel Webster, West Chester, OH (US)

(73) Assignee: General Electric Company, Schenectady, NY (US)

( * ) Notice: Subject to any disclaimer, the term of this patent is extended or adjusted under 35 U.S.C. 154(b) by 191 days.

(21) Appl. No.: 15/354,112

(22) Filed: Nov. 17, 2016

(65) Prior Publication Data

US 2018/0135425 A1 May 17, 2018

(51) Int. Cl.

| | |
|---|---|
| ***B22D 31/00*** | (2006.01) |
| ***B22D 29/00*** | (2006.01) |
| ***B22D 25/02*** | (2006.01) |
| ***B22C 9/10*** | (2006.01) |
| ***B22C 9/24*** | (2006.01) |
| *F01D 9/06* | (2006.01) |

(52) U.S. Cl.

CPC ..... *B22D 31/002* (2013.01); *B22C 9/108* (2013.01); *B22C 9/24* (2013.01); *B22D 25/02* (2013.01); *B22D 29/002* (2013.01); *F01D 9/065* (2013.01); *F05D 2230/211* (2013.01); *F05D 2260/201* (2013.01)

(58) Field of Classification Search

CPC .. B22C 9/10; B22C 9/108; B22C 9/24; B22D 25/02; B22D 29/00; B22D 29/002; B22D 31/00; B22D 31/002

USPC ..... 164/69.1, 70.1, 76.1, 132, 137, 369

See application file for complete search history.

(56) References Cited

U.S. PATENT DOCUMENTS

| | | | | |
|---|---|---|---|---|
| 5,256,340 | A | 10/1993 | Allison et al. | |
| 5,387,380 | A | 2/1995 | Cima et al. | |
| 6,530,416 | B1 | 3/2003 | Tiemann | |
| 7,237,595 | B2 | 7/2007 | Beck et al. | |
| 7,275,585 | B1 | 10/2007 | Guerche et al. | |
| 7,862,325 | B2 | 1/2011 | Pietraszkiewicz et al. | |
| 8,171,978 | B2 | 5/2012 | Propheter-Hinckley et al. | |
| 8,807,943 | B1 * | 8/2014 | Liang | F01D 5/187 415/115 |
| 8,851,151 | B2 | 10/2014 | Frasier et al. | |
| 2003/0201087 | A1 * | 10/2003 | Devine et al. | B22C 9/04 164/76.1 |

(Continued)

FOREIGN PATENT DOCUMENTS

EP 1876325 A2 1/2008

*Primary Examiner* — Kevin P Kerns

(74) *Attorney, Agent, or Firm* — Dority & Manning, P.A.

(57) ABSTRACT

The present disclosure generally relates to methods and apparatuses for forming cast parts having cast in features aligned with a casting core. The part is cast around a casting core within a casting shell. The casting core has a first feature that creates a corresponding second feature of the cast part. The casting core includes a third alignment feature that creates a corresponding fourth feature of the cast part spaced apart from the second feature of the cast part. A machining tool is aligned with the second feature of the cast part based on the fourth feature of the cast part. The machining tool machines the cast part to create the at least one passageway aligned with the second feature.

16 Claims, 6 Drawing Sheets

(56) References Cited

U.S. PATENT DOCUMENTS

| | | | | |
|---|---|---|---|---|
| 2009/0095435 | A1* | 4/2009 | Luczak et al. | B22C 9/04 164/61 |
| 2012/0168108 | A1* | 7/2012 | Farris et al. | B22C 9/103 164/15 |
| 2015/0192021 | A1 | 7/2015 | Spangler et al. | |
| 2015/0202683 | A1 | 7/2015 | Bunker | |

* cited by examiner

METHODS AND APPARATUSES USING CAST IN CORE REFERENCE FEATURES

INTRODUCTION

The present disclosure generally relates to casting core components and processes utilizing these core components.

BACKGROUND

Many modern engines and next generation turbine engines require components and parts having intricate and complex geometries, which require new types of materials and manufacturing techniques. Conventional techniques for manufacturing engine parts and components involve the laborious process of investment or lost-wax casting. One example of investment casting involves the manufacture of a typical rotor blade used in a gas turbine engine. A turbine blade typically includes hollow airfoils that have radial channels extending along the span of a blade having at least one or more inlets for receiving pressurized cooling air during operation in the engine. Among the various cooling passages in the blades, includes serpentine channel disposed in the middle of the airfoil between the leading and trailing edges. The airfoil typically includes inlets extending through the blade for receiving pressurized cooling air, which include local features such as short turbulator ribs or pins for increasing the heat transfer between the heated sidewalls of the airfoil and the internal cooling air.

The manufacture of these turbine blades, typically from high strength, superalloy metal materials, involves numerous steps. First, a precision ceramic core is manufactured to conform to the intricate cooling passages desired inside the turbine blade. A precision die or mold is also created which defines the precise 3-D external surface of the turbine blade including its airfoil, platform, and integral dovetail. The ceramic core is assembled inside two die halves which form a space or void therebetween that defines the resulting metal portions of the blade. Wax is injected into the assembled dies to fill the void and surround the ceramic core encapsulated therein. The two die halves are split apart and removed from the molded wax. The molded wax has the precise configuration of the desired blade and is then coated with a ceramic material to form a surrounding ceramic shell. Then, the wax is melted and removed from the shell leaving a corresponding void or space between the ceramic shell and the internal ceramic core. Molten superalloy metal is then poured into the shell to fill the void therein and again encapsulate the ceramic core contained in the shell. The molten metal is cooled and solidifies, and then the external shell and internal core are suitably removed leaving behind the desired metallic turbine blade in which the internal cooling passages are found.

The cast turbine blade may then undergo additional post-casting modifications, such as but not limited to drilling of suitable rows of film cooling holes through the sidewalls of the airfoil as desired for providing outlets for the internally channeled cooling air which then forms a protective cooling air film or blanket over the external surface of the airfoil during operation in the gas turbine engine. However, these post-casting modifications are limited and given the ever increasing complexity of turbine engines and the recognized efficiencies of certain cooling circuits inside turbine blades, the requirements for more complicated and intricate internal geometries is required. Moreover, as internal geometries become more intricate, additional machining needs to be aligned with the internal features. For example, the cooling holes drilled through the sidewalls of the airfoil should align with internal air passages.

In conventional methods, a cast part includes external cast datums formed in the exterior surface of the part by the casting shell. The part is loaded into a fixture that constrains the part against the cast datums. The part is then machined based on a three-dimensional model of the part (e.g., a computer-aided design (CAD) model). The present inventors have discovered that in some cases, features formed by the casting core may be offset from the cast datums due to core shift that occurs in production of the internal cast features. Accordingly, machining based on the external datums using a nominal CAD geometry may be difficult or inaccurate. Accordingly, it is desired to provide an improved casting method for three dimensional components having intricate internal voids.

SUMMARY

The following presents a simplified summary of one or more aspects of the invention in order to provide a basic understanding of such aspects. This summary is not an extensive overview of all contemplated aspects, and is intended to neither identify key or critical elements of all aspects nor delineate the scope of any or all aspects. Its purpose is to present some concepts of one or more aspects in a simplified form as a prelude to the more detailed description that is presented later.

In one aspect, the disclosure provides a method of manufacturing a cast part having at least one passageway. The method includes casting the cast part around a casting core within a casting shell. The casting core has a first feature that creates a corresponding second feature of the cast part. The casting core includes a third alignment feature that creates a corresponding fourth feature of the cast part spaced apart from the second feature of the cast part. The method includes aligning a machining tool with the second feature of the cast part based on the fourth feature of the cast part. The method includes machining the cast part with the machining tool to create the at least one passageway aligned with the second feature.

In another aspect, the disclosure provides a casting mold. The casting mold includes a casting shell and a casting core defining a cavity therebetween. The casting core includes a body having a first feature corresponding to a second feature of a part cast in the cavity. The casting core further includes a third alignment feature that extends from the body and contacts the casting shell to form an exterior surface of the cavity corresponding to a fourth feature of the part cast in the cavity.

In another aspect, the disclosure provides a casting core. The casting core includes a body portion defining a chamber within a cast part. The casting core includes a first feature on the body portion defining a partial passage between the chamber and an external surface of the cast part. The casting core includes a second alignment feature connected with the body portion and spaced apart from the first feature, wherein the second alignment feature extends to an external surface of the cast part and defines a third external feature on the cast part.

These and other aspects of the invention will become more fully understood upon a review of the detailed description, which follows.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

Figure 1:
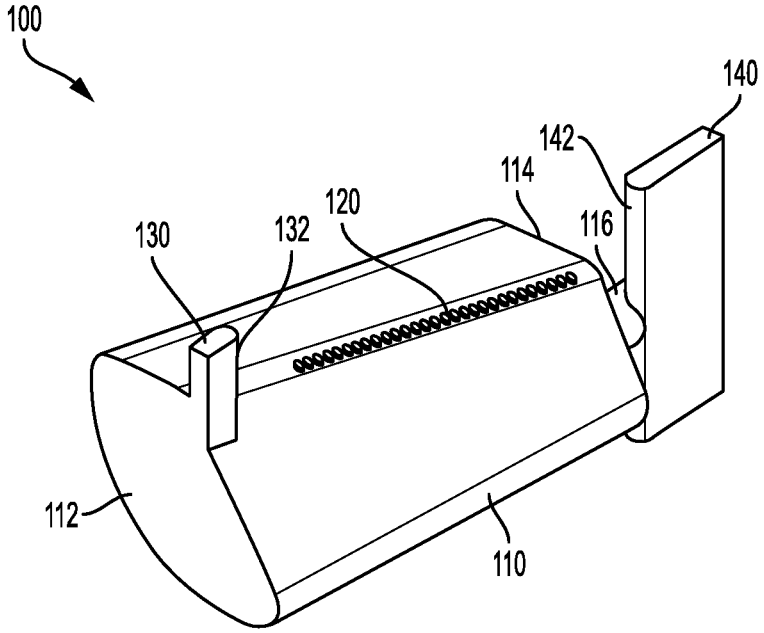
FIG. 1 illustrates a perspective view showing an example of casting core, according to an aspect of the disclosure.

FIG. 1 illustrates a perspective view of an example of a casting core 100 according to an aspect of the disclosure. The casting core 100 may be a ceramic casting core formed by any technique known in the art. In an aspect, the casting core 100 may be formed using an additive manufacturing technique for plastics or ceramics. For example, the casting core may be formed using powder bed printing or direct print ceramic. Methods for using 3-D printing to produce a ceramic core-shell mold are described in U.S. Pat. No. 8,851,151 assigned to Rolls-Royce Corporation. The methods for making the molds include powder bed ceramic processes such as disclosed U.S. Pat. No. 5,387,380 assigned to Massachusetts Institute of Technology, and selective laser activation (SLA) such as disclosed in U.S. Pat. No. 5,256,340 assigned to 3D Systems, Inc.

The casting core 100 may be used to form internal features of a part such as a turbine blade. Although an example is provided with respect to a turbine blade, the disclosed techniques are applicable to any investment casting process using an internal casting core.

The example casting core 100 includes a body 110 having a first end 112 and an opposite second end 114. The body 110 may be located within a casting shell (not shown) to form a cavity between the casting core 100 and the shell. A casting material (e.g., melted super-alloy) may be injected into the casting shell and fill the cavity surrounding the casting core 100. Accordingly, once removed, the body 110 of the casting core 100 may form an internal cavity within a cast part. In an aspect, one or both of the first end 112 or the second end 114 may be coupled with the casting shell or extend through the casting shell. For example, the first end 112 may extend through the casting shell while the second end 114 may be located within the casting shell. In the illustrated example, the casting core 100 further includes an extension 116 that extends beyond the second end 114 of the body 110. The extension 116 may extend to or through the casting shell.

The casting core 100 further includes a plurality of features 120. In the illustrated example, the features 120 include a row of protrusions. The features 120 are located on an external surface of the body 110. When the part is cast around the casting core 100, the features 120 may become partial passages. For example, the features 120 may extend from the core into the cast part. When the casting core is removed, passages in the cast part may remain in place of the features 120. For example, the features 120 may form a metering portion of a film cooling feature in the cast part. Although, for the sake of clarity, a relatively simple feature 120 is illustrated, it should be appreciated that the feature 120 may include more intricate features that may be created on a casting core.

The casting core 100 further includes alignment features 130 and 140. The alignment feature 130 is located at the first end 112 and extends from the body 110. As will be discussed in further detail below, the alignment feature 130 is integrally formed with the body 110. Accordingly, the position of the alignment feature 130 with respect to the features 120 does not change during a casting process. In an aspect, the alignment feature 130 extends to a location that remains accessible after the casting process. For example, the alignment feature 130 may extend to or through a casting shell. At least one surface of the alignment feature 130 may define a portion of the casting cavity. For example, the surface 132 may face toward the body 110 and define a portion of the casting cavity. For example, the casting shell may be formed around other portions of the alignment feature 130, but leave the surface 132 exposed. Accordingly, the alignment feature 130 may define a corresponding feature on the cast part. Accordingly, when the casting shell and casting core 100 are removed, the corresponding feature on the cast part may remain accessible. The alignment feature 140 may be similar to the alignment feature 130. In the illustrated example, the alignment feature 140 extends from the extension 116 opposite the first end 112. Like the alignment feature 130, the alignment feature 140 may extend to or through the casting shell. The alignment feature 140 includes a surface 142 that faces toward the body 110 and defines a portion of the casting cavity where the surface 142 is exposed. Accordingly, the alignment feature 140 may define a corresponding feature (e.g., a groove) on the cast part.

Figure 2:
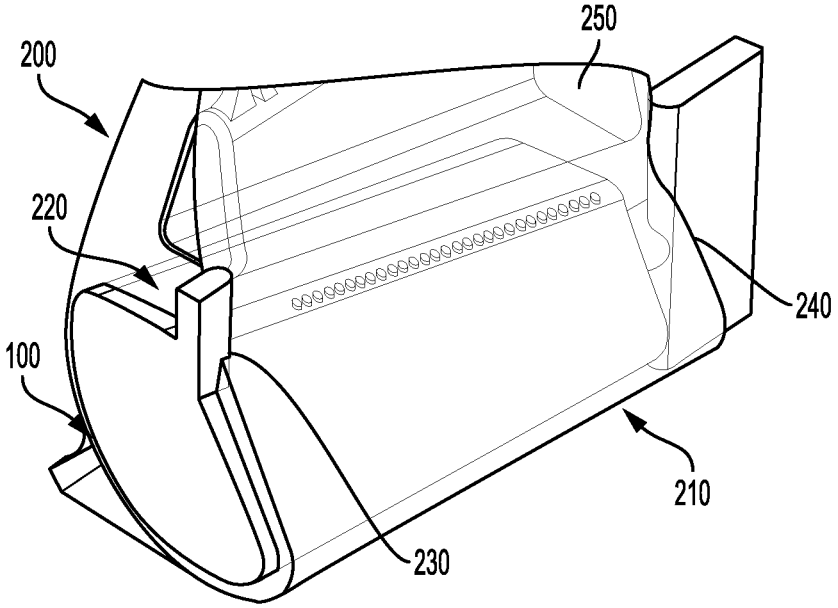
FIG. 2 illustrates a perspective view showing an example of casting core and cast part, according to an aspect of the disclosure.

FIG. 2 illustrates a perspective view of the casting core 100 and a cast part 200. The cast part 200 may be cast around the casting core 100 using a casting shell (illustrated in FIG. 3). The casting shell defines the majority of an external surface 210 of the cast part 200. The cast part 200 also includes an internal surface 220 defined by the casting core 100. The alignment features 130, 140 define corresponding features 230, 240 of the external surface 210. The corresponding feature 230 is, for example, an indentation or groove in the cast part 200 formed by the surface 132 of the alignment feature 130. Similarly, the corresponding feature 240 is an indentation or groove in the cast part 200 formed by the surface 142 of the alignment feature 140. In an aspect, the corresponding features 230 and 240 are formed in an excess portion of the cast part 200. For example, the excess portion may not form a portion of a finished part. Accordingly, the excess portion and the corresponding features 230, 240 therein may be machined away. The finished part may include no trace of the corresponding features 230, 240.

The cast part 200 may also include internal passages 250. The internal passages 250 may be formed, for example, by another casting core, which may be connected to or separate from the casting core 100. The internal passages 250 may provide, for example, passages for fluid flow through the finished part. In an aspect, the cast part 200 may be machined to connect the internal surface 220 with the internal passages 250. For example, machining may be used to cut or drill slots or holes. As discussed in further detail below, the corresponding features 230, 240 may be used to align machining tools with respect to the internal surface 220 and/or the internal passages 250.

Figure 3:
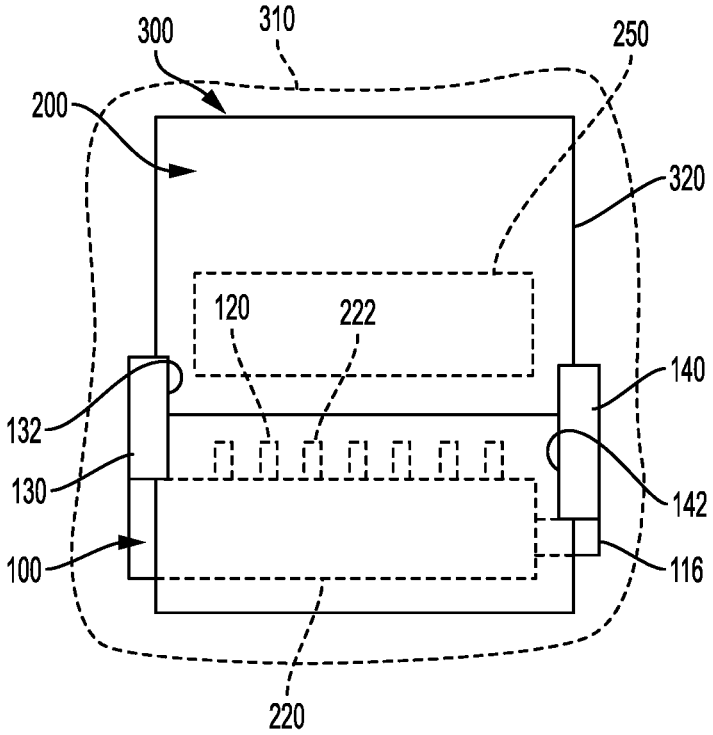
FIG. 3 illustrates a front view of the example casting core and cast part of FIG. 2 with a casting shell, according to an aspect of the disclosure.

FIG. 3 illustrates a front view of the casting core 100, the cast part 200, and a casting shell 300. The casting shell 300 may partially or completely surround the cast part 200. In an aspect, the casting shell 300 is formed by spackling a molded wax form having the casting core embedded therein. In another aspect, the casting shell 300 may be formed using an additive manufacturing process to build the casting shell 300 in the desired shape without a wax form. An outer surface 310 of the casting shell 300 may be any shape. The thickness of the casting shell 300, for example, may be determined based on desired structural or thermal properties of the casting shell. An internal surface 320 of the casting shell 300 defines the external surface 210 of the cast part 200. In an aspect, the alignment features 130, 140 extend to or into the casting shell 300. For example, the alignment features 130, 140 extend out of the wax form and the spackling process coats the alignment features 130, 140 as well as the wax form. Accordingly, the alignment features 130, 140 form a portion of the external surface 210 of the cast part 200. In particular, the surface 132 defines the corresponding feature 230 on the external surface of the cast part 200 instead of the casting shell 300. Similarly, the surface 142 defines the corresponding feature 240 on the external surface of the cast part 200 instead of the casting shell 300.

The features 120 of the casting core 100 define corresponding features 222 of the cast part 200. For example, the corresponding features 222 may be negative features such as indentations, passageways, or tubes within the cast part 200. In another aspect, the features 120 of the casting core 100 may be negative features and the corresponding features 222 may be positive features such as protrusions, ridges, or walls. In an aspect, the corresponding features 222 are located internally within the cast part 200. Accordingly, when further machining related to the corresponding features 222 is desirable, it may be difficult to align a machining tool with the corresponding features 222.

Figure 4:
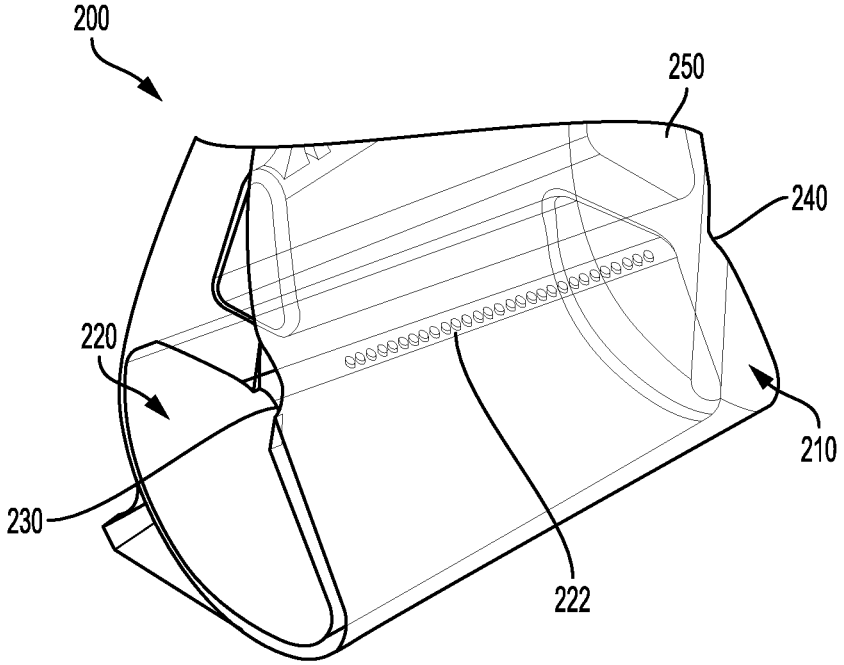
FIG. 4 illustrates a perspective view of an example cast part, according to an aspect of the disclosure.

FIG. 4 illustrates a perspective view of the cast part 200 without the casting core 100 or the casting shell 300. For example, the cast part 200 may be an unfinished cast part after completion of the casting process and removal of the casting core 100 and casting shell 300 by appropriate techniques. Further machining of cast part 200 may be performed to finish the cast part 200. For example, the corresponding features 222 may not form a through passage. Accordingly, machining may be used to create through passages connecting the corresponding features 222 to the external surface 210. As another example, the cast part 200 includes the internal passages 250. Machining may be used to create a passage from internal surface 220 to the internal passages 250. The corresponding features 230, 240 may be used to align a machining tool with the corresponding features 222 and/or the internal passages 250.

Figure 5:
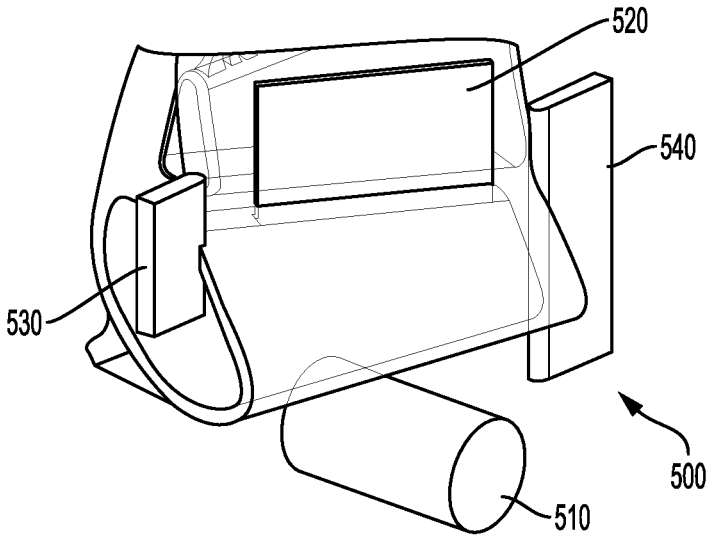
FIG. 5 illustrates a perspective view of a machining tool aligned with features of a cast part, according to an aspect of the disclosure.

FIG. 5 illustrates a perspective view conceptually illustrating alignment of a machining tool 500 with the cast part 200. In an aspect, the machining tool 500 includes a holding fixture including one or more locators. For example, the machining tool 500 includes a first locator 530 that engages the corresponding feature 230 and a second locator 540 that engages the corresponding feature 240. The machining tool 500 may additionally include a third locator 510 that contacts the external surface 210 of the cast part 200. Although illustrated as separate components, the locators 510, 530, and 540 may be coupled together. For example, each of the locators 510, 530, and 540 may be coupled to a platform and movable into a determined configuration for aligning the cast part 200 with the tool 500. As previously discussed, because the corresponding features 230 and 240 were formed by a portion of the casting core 100 rather than a portion of the casting shell 300, the corresponding features 230 and 240 are not subject to core shift during the casting process. In other words, if the casting core 100 shifts during casting, the corresponding features 230 and 240 will still be aligned with other features formed by the casting core 100. Accordingly, the corresponding features 230 and 240 are aligned with the internal corresponding features 222 and may be used as reference points for the machining operation.

The machining tool 500 further includes a machining head 520. The machining head 520 may include any tool for e.g., milling, drilling, laser cutting, electro-discharge machining (EDM), etching, liquid jet machining, or stamping. The machining head 520 may be moved by the machining tool 500 to the appropriate location of the cast part 200 in alignment with the internal corresponding features 222 to create a machined feature such as a hole, slot, or shape. In an aspect, the machined feature may have a width or diameter less than 0.050 inches, preferably in the range of 0.005 to 0.040 inches, more preferably in the range of 0.010 to 0.020 inches. For comparison, casting manufacturing processes may have a casting tolerance of ±0.005 inches. Accordingly, if the machining operation were to be misaligned with the corresponding features 222 even within the casting tolerance, the machined feature may miss or only partially intersect the corresponding features 222, thereby affecting performance of the finished part. However, by aligning the machining tool 500 based on the corresponding features 230 and 240, which are aligned with the corresponding features 222 by virtue of being formed by the same casting core 100, the casting tolerance with respect to the aligned features may be reduced. Accordingly, the disclosed techniques produce better alignment and lower scrap rates.

Figure 6:
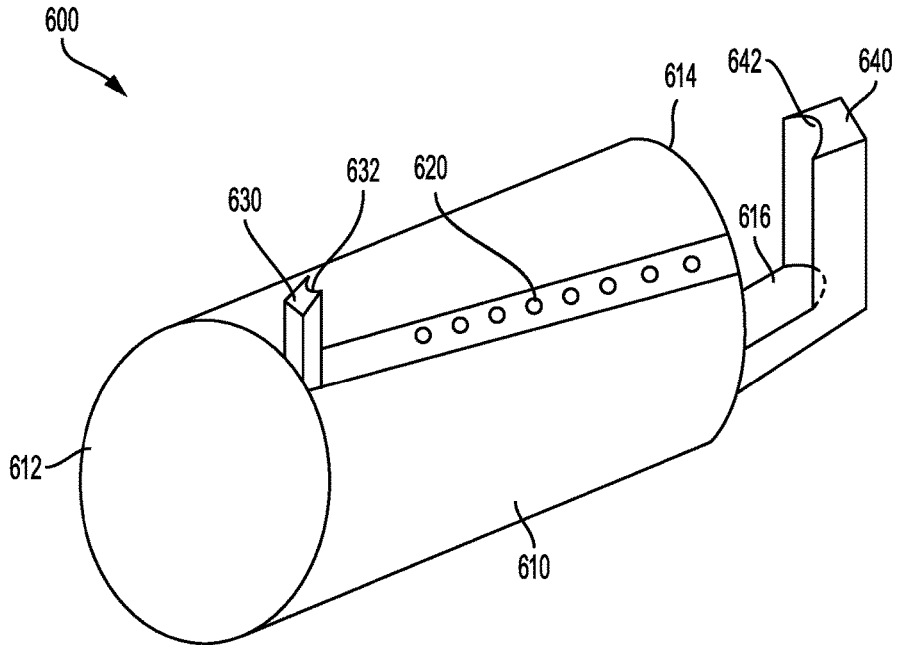
FIG. 6 illustrates a perspective view of another example casting core according to an aspect of the disclosure.

FIG. 6 illustrates a perspective view of another example casting core 600 according to an aspect of the disclosure. The casting core 600 is generally similar to casting core 100 and may be used to form internal features of a part such as a turbine blade. As discussed above with respect to FIG. 1, the casting core 600 may be a ceramic casting core formed by any technique known in the art.

The casting core 600 includes a body 610 having a first end 612 and an opposite second end 614 with an extension 616. The casting core 600 further includes a plurality of features 620 that form internal features of the cast part. The casting core 600 further includes alignment features 630 and 640. The alignment feature 630 is located at the first end 612 and extends from the body 610. The alignment feature 630 includes a concave surface 632. Accordingly, a corresponding feature (e.g., a protrusion) of the cast part may have a convex surface that extends beyond the part. The corresponding feature may be used to align the machining tool 500. The convex surface of the corresponding feature may then be easily machined away. Similarly, the alignment feature 640 includes a concave surface 642, which may result in a convex surface of a corresponding feature (e.g., a protrusion) of the cast part.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

The invention claimed is:

1. A method of manufacturing a cast part having at least one passageway, comprising:

casting the cast part around a casting core within a casting shell, the casting core having a first feature that creates a corresponding second feature of the cast part, the casting core including an alignment feature that creates a corresponding alignment feature of the cast part spaced apart from the second feature of the cast part;

engaging the corresponding alignment feature of the cast part with a locator of a machining tool to align the machine tool with the cast part;

aligning the machining tool with the second feature of the cast part based on the engagement of the corresponding alignment feature of the cast part with the locator of the machining tool; and machining the cast part with the machining tool to create the at least one passageway aligned with the second feature.

2. The method of claim 1, wherein the second feature of the cast part is an internal feature and the corresponding alignment feature of the cast part is an external feature.

3. The method of claim 1, further comprising machining away the corresponding alignment feature of the cast part.

4. The method of claim 1, further comprising leaching the casting core from the cast part.

5. The method of claim 1, wherein the corresponding alignment feature of the cast part is a groove.

6. The method of claim 1, wherein the corresponding alignment feature of the cast part is a protrusion.

7. The method of claim 1, wherein the cast part has a casting tolerance of approximately 0.005 inches in any direction.

8. The method of claim 7, wherein the at least one passageway has a diameter between 0.010 and 0.020 inches.

9. The method of claim 1, further comprising fabricating the casting shell including the casting core.

10. The method of claim 9, wherein fabricating the casting shell comprises spackling a wax part and the casting core with a ceramic slurry, wherein the alignment feature protrudes at least partially from the wax part.

11. The method of claim 1, wherein the alignment feature of the casting core contacts the casting shell and defines at least a portion of an external surface of the cast part.

12. The method of claim 1, wherein the alignment feature is a first alignment feature, wherein the corresponding alignment feature of the cast part is a first corresponding alignment feature of the cast part, wherein the casting core further includes a second alignment feature spaced apart from the first alignment feature, and wherein the second alignment feature creates a second corresponding alignment feature of the cast part.

13. The method of claim 12, wherein machining the cast part comprises machining the cast part between the first corresponding alignment feature of the cast part and the second corresponding alignment feature of the cast part.

14. The method of claim 12, wherein the engaging the corresponding alignment feature of the cast part with the locator of the machining tool comprises contacting the first corresponding alignment feature of the cast part and the second corresponding alignment feature of the cast part with mechanical locators of the machining tool and aligning a machining head with the second feature based on the mechanical locators and a model of the part.

15. The method of claim 12, wherein the engaging the corresponding alignment feature of the cast part with the locator of the machining tool comprises aligning the machining tool with the second feature of the cast part by using the first corresponding alignment feature of the cast part in the second corresponding alignment feature of the cast part, and one external as-cast feature.

16. The method of claim 1, wherein aligning the machining tool with the second feature of the cast part based on the engagement of the corresponding alignment feature of the cast part with the locator of the machining tool comprises contacting the alignment feature of the cast part with a mechanical locator of the machining tool and aligning a machining head with the second feature based on the locator and a model of the part.

* * * * *